US009681734B2

(12) United States Patent
Hatch

(10) Patent No.: US 9,681,734 B2
(45) Date of Patent: Jun. 20, 2017

(54) DUAL BRUSH EYELASH APPLICATOR WITH REVERSE ACTION APPARATUS

(71) Applicant: LASH DUET, LLC, Orem, UT (US)

(72) Inventor: Lisa Hatch, Orem, UT (US)

( * ) Notice: Subject to any disclaimer, the term of this patent is extended or adjusted under 35 U.S.C. 154(b) by 0 days.

(21) Appl. No.: 15/099,124

(22) Filed: Apr. 14, 2016

(65) Prior Publication Data

US 2016/0220009 A1 Aug. 4, 2016

Related U.S. Application Data

(62) Division of application No. 14/046,760, filed on Oct. 4, 2013, now Pat. No. 9,314,085.

(60) Provisional application No. 61/709,845, filed on Oct. 4, 2012.

(51) Int. Cl.

| | |
|---|---|
| ***A45D 26/00*** | (2006.01) |
| ***A45D 2/48*** | (2006.01) |
| ***A45D 40/26*** | (2006.01) |
| ***A45D 34/04*** | (2006.01) |
| ***A45D 2/04*** | (2006.01) |
| ***A46B 5/00*** | (2006.01) |
| ***A45D 40/24*** | (2006.01) |

(52) U.S. Cl.

CPC ..... *A45D 40/262* (2013.01); *A45D 34/042* (2013.01); *A45D 40/24* (2013.01); *A45D 40/267* (2013.01); *A46B 5/0012* (2013.01); *A46B 2200/1053* (2013.01)

(58) Field of Classification Search

CPC ..... A45D 34/042
USPC ..... 401/126
See application file for complete search history.

(56) References Cited

U.S. PATENT DOCUMENTS 5,052,839 A * 10/1991 Pettengill ..... A45D 40/265 401/10
5,176,156 A 1/1993 Ashtary et al.
5,662,659 A 9/1997 McDonald
(Continued)

FOREIGN PATENT DOCUMENTS

CN 202179264 4/2012
DE 202011100182 U1 8/2012
(Continued)

OTHER PUBLICATIONS

Sito Iozhka, "Filtering and bottling of sparkling wines," Mar. 14, 2012, accessible online at <URL:http://wine.historic.ru/books/item/f00/s00/z0000016/st033.shtml/>.

*Primary Examiner* — Mark A Laurenzi
*Assistant Examiner* — Thomas M Abebe
(74) *Attorney, Agent, or Firm* — Pate Baird, PLLC

(57) ABSTRACT

A mascara application system includes an applicator for mascara and a mascara container. The applicator may include two brushes, and have a reverse tweezers arrangement, by which the brushes may be spaced apart from one another when pressure is applied to a handle portion of the applicator, and the brushes may be positioned adjacent to one another when no pressure is applied to the handle portion. An optional applicator container may hold a handle portion of the applicator, while enabling its actuation to operate the applicator. The mascara container, which holds mascara and is configured to receive the brushes, may include a separate portal for each brush, as well as a squeegee or other element for removing excess mascara from each brush. Methods for applying mascara to lashes are also disclosed.

17 Claims, 10 Drawing Sheets

(56) References Cited

U.S. PATENT DOCUMENTS

| | | | | |
|---|---|---|---|---|
| 6,120,202 | A | 9/2000 | Donsky | |
| 6,916,054 | B1 * | 7/2005 | Baldesberger | A45D 26/0066 294/99.2 |
| 9,314,085 | B2 * | 4/2016 | Hatch | A45D 34/042 |
| 2008/0006287 | A1 | 1/2008 | Gueret | |
| 2010/0089414 | A1 * | 4/2010 | Wyatt | A45D 40/265 132/217 |
| 2010/0242981 | A1 | 9/2010 | Bouix | |
| 2011/0293352 | A1 | 12/2011 | Kim | |
| 2014/0099152 | A1 * | 4/2014 | Hatch | A45D 40/267 401/121 |
| 2016/0220009 | A1 * | 8/2016 | Hatch | A45D 40/267 |

FOREIGN PATENT DOCUMENTS

| | | | |
|---|---|---|---|
| EP | 1652449 | | 5/2006 |
| EP | 1652449 | A2 | 5/2006 |
| WO | WO2010117832 | A2 | 10/2010 |

* cited by examiner

DUAL BRUSH EYELASH APPLICATOR WITH REVERSE ACTION APPARATUS

RELATED APPLICATIONS

This application: is a divisional (continuation) of U.S. patent application Ser. No. 14/046,760, filed Oct. 4, 2013; which claims the benefit of U.S. Provisional Patent Application Ser. No. 61/709,845, filed Oct. 4, 2012; both of which are incorporated herein by reference in their entirety.

BACKGROUND

1. Field of the Invention

This disclosure relates generally to cosmetics and, more specifically, to applicators and mascara containers.

2. Background Art

Mascara usage dates back to 4000 B.C. in ancient Egypt. Originally, mascara was applied to eyelashes with applicators made of bone and ivory. The modern applicator wand was developed in the 1960s, and efforts have continued to make better applicators. Various types of brushes have been devised. Fat brushes create voluptuous, voluminous lashes; skinny brushes coat each lash perfectly while separating and not clumping; and curved wands help curl lashes.

Many technological advances have shaped the industry, from adding fibers or supplementing formulations with collagen and keratin, to creating uniquely shaped brushes, to "notice-me" packaging that enhances product attributes and entices consumers to purchase. However, the basic structure of a wand applicator with a single brush has remained essentially unchanged. Accordingly, the proper application of mascara typically involves separately coating the upper and under sides of a top lash, using only one wand and one brush.

Mascara is the universally most-preferred cosmetic, but it is also the most time-consuming cosmetic to adequately apply. The three main features a consumer wants from her mascara and applicator are volume, length and separation, each of which may require a different type of applicator. Some cosmetic companies offer dual-ended mascara containers, with one brush on either end to try to facilitate each of these three purposes.

BRIEF SUMMARY OF THE INVENTION

This disclosure relates to mascara application systems that include applicators with two brushes. Even more particularly, this disclosure relates to applicators with handle portions that cause the brushes to be spaced apart from one another when pressure is applied to the handle portion, and that enable the brushes to be positioned adjacent to one another when no pressure is applied by a user to the handle portion.

A dual brush mascara applicator according to this disclosure comprises a handle including a first arm and a second arm. At one end, each of the first arm and the second arm includes a handle portion. At the opposite end, each of the first arm and the second arm includes an applicator end. A first mascara brush is positioned at or on the applicator end of the first arm, and a second mascara brush is positioned at or on the applicator end of the second arm. The first arm crosses the second arm so that transverse movement of the handle portion of the first arm relative to the handle portion of the second arm causes an opposite transverse movement of the first brush relative to the second brush.

The dual brush mascara applicator may further include a mascara container including a first opening for the first brush, a second opening for the second brush, and squeegee attachments associated with the first and second openings for removing excess mascara from the first and second brushes.

The dual brush mascara applicator may also include an applicator container for the handle portions of the first and second arms. The applicator container may include a movable member for applying transverse force to the first arm and/or the second arm to cause transverse movement of the first arm and/or the second arm.

Methods for applying mascara are also disclosed. In such a method, with the brushes in an open arrangement (i.e., spaced apart from one another), they may be placed on opposite sides of lashes to which mascara is to be applied. Once the brushes are in place, they may be placed in a closed arrangement (i.e., against one another), enabling the two brushes to engage the lashes, and to work together for easy application of mascara to the eyelashes.

Other features, as well as various features and advantages, of the disclosed subject matter will become apparent to those of ordinary skill in the art through consideration of the ensuing description, the accompanying drawings and the appended claims.

As used herein, the terms "reverse tweezers" or "reverse action" refer to apparatuses that include a mechanism that causes separate tips at one end of the apparatus to move away from one another as corresponding handle portions at an opposite end of the apparatus are pushed transversely towards each other. Conversely, the release of the transverse force that was pushing adjacent handle portions of the apparatus together results in causing movement of the tips of the apparatus towards each other.

A mascara applicator that incorporates these features includes two brushes mounted on a handle that operates by a reverse tweezers action. Each of the arms of the handle includes a handle portion at one end and a wand at the other end. The brushes of such an applicator, which are located at ends of the wands, may work together in tandem to simultaneously apply mascara to the upper and under sides of a top lash. Mascara may be applied to the brushes in a mascara container that has separate, adjacent (e.g., parallel, etc.) ports to accept each wand and its corresponding brush. In the reverse tweezers mechanism, the two wands are connected together so that the brushes are normally (when the applicator arms are in a relaxed state) in a closed arrangement, where they may be nestled together, and the wands may be moved apart from each other as a user squeezes the handle portions of the arms together. Thus, wands and brushes move apart from one another, or open, when pressure is applied to the handle portions, and the brush ends move towards one another, or close, when the pressure on the handle portions is released.

The two-brush reverse action apparatus of the present invention enables a user to spread the brushes to accept an eyelash and then release the pressure on the arms, so that the brushes return to their closed nestled position applying a steady pressure to the brushes in contact with the eyelash. The user may then smoothly pull the mascara applicator forward and upward, away from her lashes, leaving a residue of mascara on either side of her lashes. This action is repeated as necessary to achieve a desired appearance. The apparatus also enables a user to achieve desired amounts of volume, length and separation of their lashes, using a combination of brush shapes, styles and mediums on the ends of the wands.

The present disclosure also provides for a movable outer container, which is also referred to herein as an "applicator container," for the handle portions of the arms of the reverse action applicator. The applicator container has movable parts so that when pressure is applied the handle portions of the arms, the reverse action mechanism is actuated to move the wands and brushes away from each other. When the pressure is released, the reverse action mechanism is deactuated, enabling the wands and brushes to move back together. The movable container may include one or more movable members that actuate(s) one or both of the handle portions of the applicator. In some embodiments, the movable members may define pressure points on the container that, when pushed or pressed together, move the handle portions of the arms of the applicator. This action opens the wands for positioning the brushes over the user's lashes. Thereafter, when the user releases the pressure on the movable member(s) of the applicator container, the wands of the applicator may close, bringing the brushes together.

A mascara container may have a dual portal with dual squeegees to house to contain the dual wands of the applicator when the applicator is not in use or when the application of mascara to the brushes is desired. These dual portals enable the dual wands and brushes to slide in and out of the portals. Each portal may include a squeegee member that removes any excess mascara from its corresponding brush as the wands are pulled from the mascara container. The squeegee members may also help seal the mascara from the surrounding air when the wands of the applicator have been removed to apply mascara, as well as when the wands of the applicator are housed in the portals.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
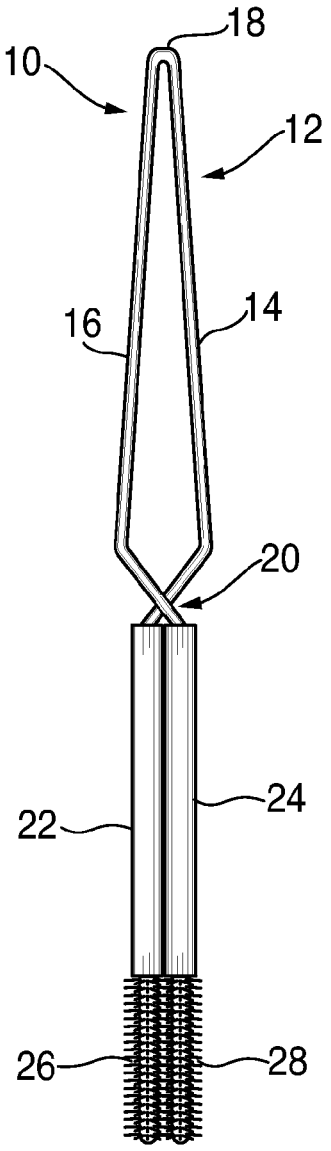
FIG. 1 is a front, elevation view of a dual brush eyelash applicator with reverse action in a closed position.
Figure 2:
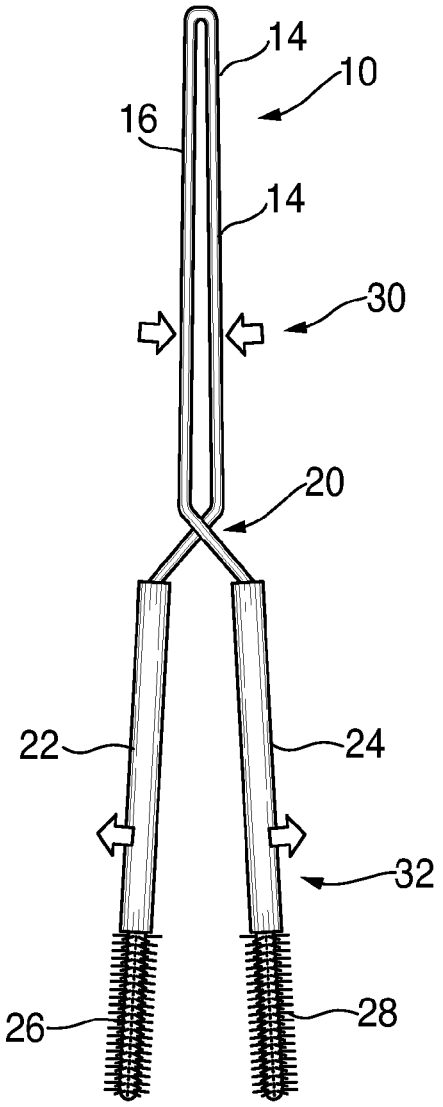
FIG. 2 is a front, elevation view thereof in an open position.

Referring to FIGS. 1 and 2, a simplified embodiment of an applicator 10 is shown, in which the reverse tweezers effect is easily seen. FIG. 1 shows a simplified embodiment of an applicator 10 having a reverse tweezers mechanism 12, consisting of arms 14 and 16 that are joined at an apex 18 at a proximal end, or handle portion 12, of the applicator 10. The arms 14 and 16 cross over at point 20, which may be located somewhat centrally along the length of the applicator 10. The portions of the arms 14 and 16 that are located on the distal side of point 20 are referred to as wands 22 and 24. Brushes 26 and 28 are attached to the distal ends of the wands 22 and 24, respectively.

The applicator 10 may be made of a flexible material that can bend when pressure is applied. Accordingly, when a pinching pressure 30 is applied to the handle portions of arms 14 and 16, they tend to move closer together, as shown in FIG. 2. Since the arms 14 and 16 cross over at point 20, that action of the arms has an opposite effect on the wands 22 and 24 and their brushes 26 and 28, causing the wands 22 and 24 and their respective brushes 26 and 28 to move away from each other, as shown by arrows 32.

Thus, the diameter of the handle portion 12 depresses and expands when pinching pressure 30 is applied, so that the user may spread the distal ends of the two wands 22 and 24 with attached brushes 26 and 28, and then close the wands 22 and 24 and their respective brushes 26 and 28 in order to have the brushes 26 and 28 surround or hug a user's lashes.

Figure 3:
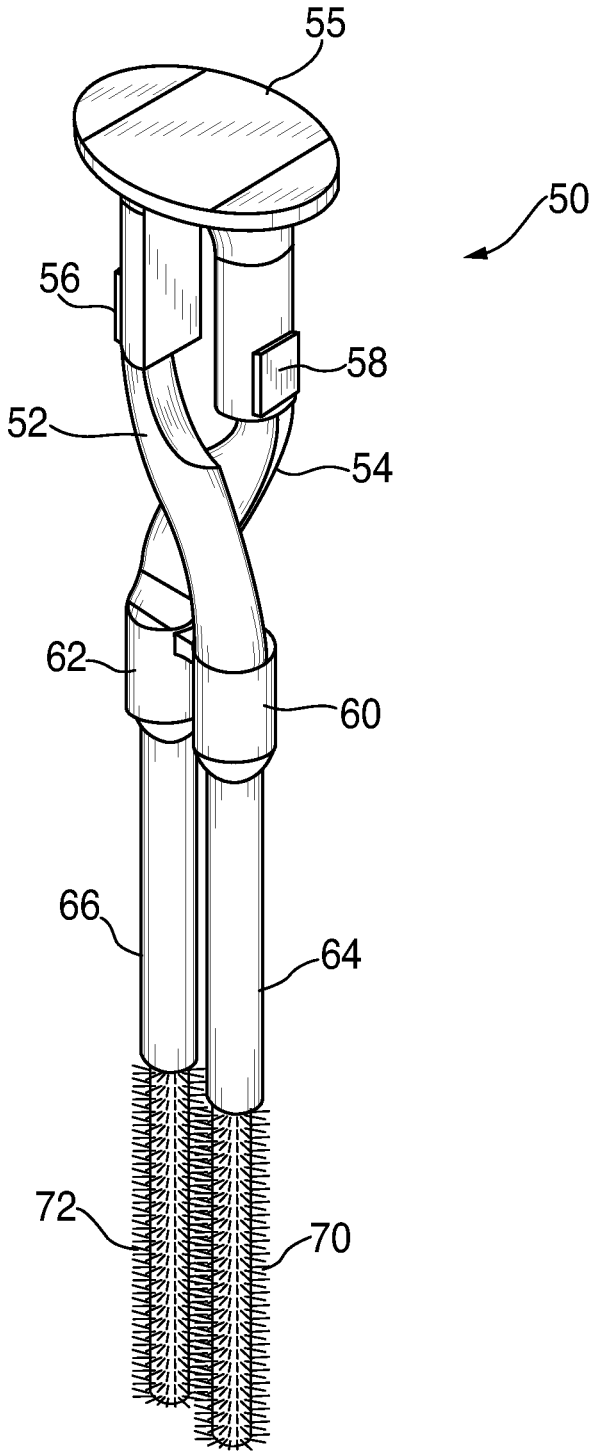
FIG. 3 is a perspective view of an alternative embodiment of an applicator in accordance with the invention.

Referring now to FIG. 3, another embodiment of an applicator 50 is shown. That applicator 50 comprises a first arm 52 and a second arm 54 that cross over each other. The proximal ends of the arms 52 and 54 may be connected to oval tab 55 or they may be connected to each other in any other suitable manner to form a flexible hinge at the proximal end of the applicator 50. A pressure point 56 may be located on a proximal part of arm 54 and a pressure point 58 may be located on a proximal part of arm 56. Distal ends 60 and 62 of the arms 52 and 54, which are located on a distal side of a location where the arms 52 and 54 cross over one another, may be connected to wands 64 and 66, respectively. Brushes 70 and 72 are respectively secured to the distal ends of the wands 64 and 66.

Figure 4:
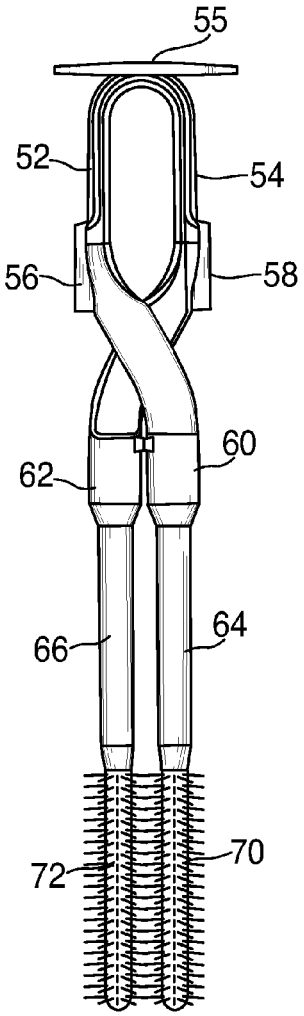
FIG. 4 is a front, elevation view thereof in a closed position.
Figure 5:
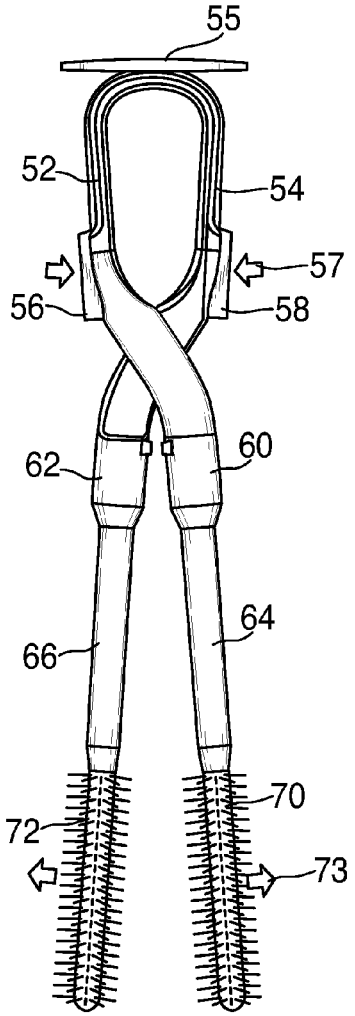
FIG. 5 is a front, elevation view thereof in an open position.
Figure 6:
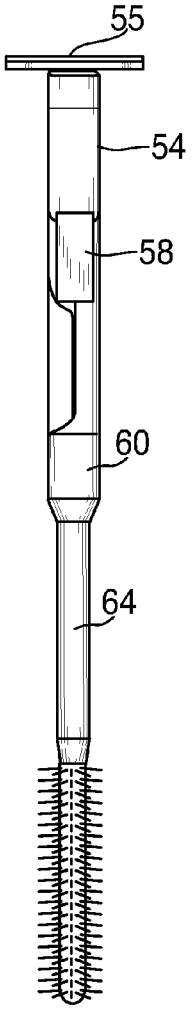
FIG. 6 is a right side, elevation view thereof.

As seen in FIGS. 4 through 6, this crossed-over structure of arms 52 and 54 creates a reverse tweezers mechanism. That is, as shown in FIG. 5, when transverse or pinching pressure 57 is applied by a user against pressure points 56 and 58, the distal ends 60 and 62 of the arms 52 and 54 tend to move in the opposite transverse direction, away from each other. Consequently, an outward force 73 causes the wands 64 and 66 and the brushes 70 and 72 to move away from each other. Conversely, as shown in FIG. 4, when the transverse or pinching pressure is released from the pressure points 56 and 58, the distal ends 60 and 62 of the arms 52 and 54 tend to move back together. Consequently, the wands 64 and 66 and the brushes 70 and 72 also move back together, to their original resting positions.

Figure 7:
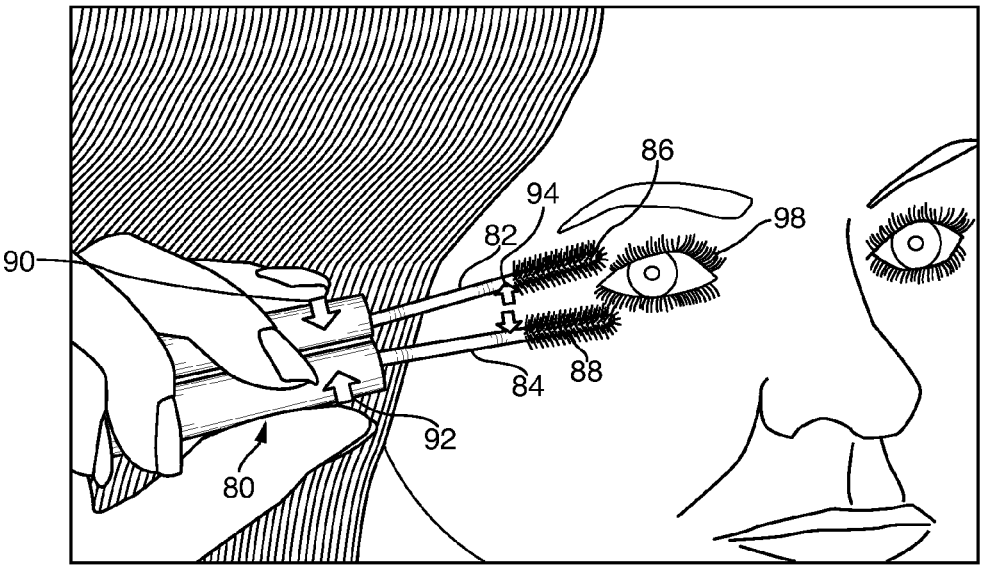
FIG. 7 is a perspective view thereof of an applicator in an open position in preparation to apply mascara in a method in accordance with the invention.
Figure 8:
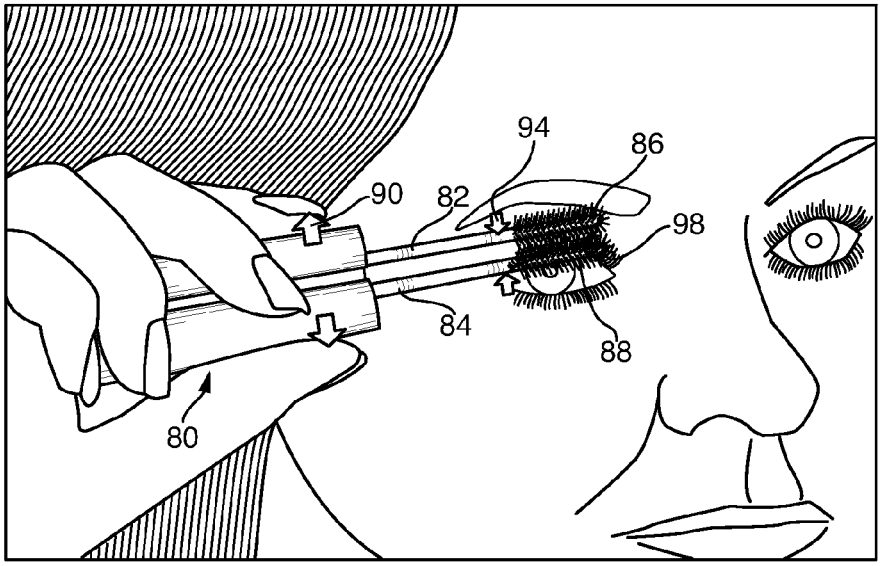
FIG. 8 is a perspective view thereof with the applicator in a closed position applying mascara to a lash.

Looking now at FIGS. 7 and 8, an embodiment of a process for using an applicator to apply mascara is depicted. In FIG. 7, applicator container 80 is shown as containing a reverse tweezers mechanism of a handle portion of an applicator, to be discussed in more detail hereafter. A user pinches pressure points 90 and 92 on the applicator container 80, causing wands 82 and 84 to separate. Brushes 86 and 88 on the ends of wands 82 and 84, which are laden with mascara for application to the eyelash 98, also separate. A separation space 94 between the brushes 86 and 88 enables the user to place a set of her lashes 98 (e.g., lashes on an upper eyelid, lashes on a lower eyelid, etc.) between the brushes 86 and 88.

Figure 9:
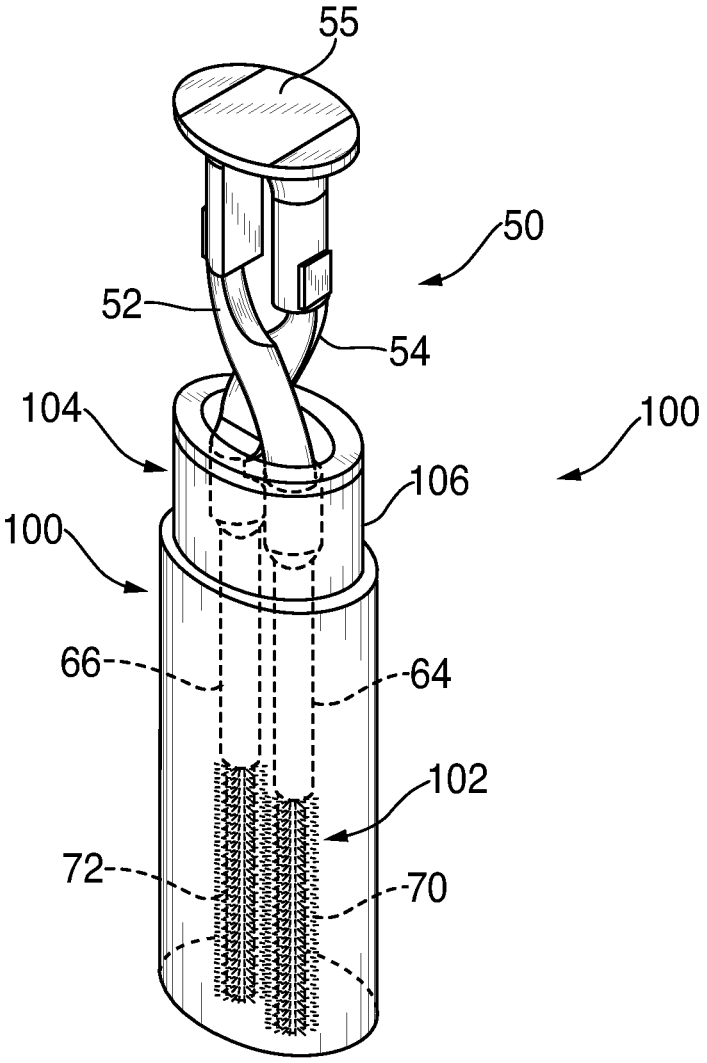
FIG. 9 is a perspective view of an applicator of FIG. 3 inserted into a reservoir of a container in accordance with the invention.

FIG. 9 shows the user releasing pressure from the pressure points 90 and 92, thereby causing the wands 82 and 84 to move towards each other and the separation space 94 to diminish. The brushes 86 and 88 come together on the top side and the bottom side, respectively, of the lashes 98. The user draws container applicator 80 away and up from the lashes 98, causing the brushes 86 and 88 to deposit and distribute the mascara over the lashes 98 as the brushes 86 and 88 are pulled in a forward direction across and off of the lashes 98.

The dual brushes working together in tandem with each other may achieve multiple functionality of providing a desired volume, a desired length and a desired amount of eyelash separation. A thicker circumference brush holds more mascara within its brushes so it achieves a more voluminous look. A thinner circumference brush with multiple bristles achieves a longer looking lash. And a thinner circumference brush with thinner, more separated bristles achieves lash separation. In the present embodiment, the upper brush 86 may have a thicker circumference to focus on applying mascara in a manner that makes the lashes 98 appear to be thicker. The lower brush 88 may have a thinner circumference to apply mascara in a manner that makes the lashes 98 appear to be longer. However, any combination of brushes may be used to achieve a desired appearance.

Looking next at FIG. 9, a mascara container 100 is shown. A mascara receptacle 102 is located at the bottom of the mascara container 100. A top portion 104 of the container may include a wall 106 with a smaller outer dimension than the corresponding outer dimension of the wall of the receptacle 102, with a ledge defining a boundary between the outer surfaces of the receptacle 102 and the outer surfaces of the wall 106. This difference in dimensions may accommodate an end of an applicator container (not shown in FIG. 9) or otherwise facilitate coupling of an applicator container to the mascara container 100.

The applicator 50 may be placed in the mascara container 100, so that the wands 64 and 66 and their respective brushes 70 and 72 extend into the mascara receptacle 102 for storage and/or to receive the mascara therein. The mascara container 100 may have a dual-squeegee portal (not shown in FIG. 9) to accommodate the two wands 64 and 66 and brushes 70 and 72 of the applicator 50. The user may apply slight pressure to the arms 52 and 54 of the applicator 50 the wands 64 and 66 enough to enable them to align with and to be inserted into their respective portal (not shown in FIG. 9) of the receptacle 102 of the mascara container 100. Once the brushes 70 and 72 are in place within their respective portals, they may gather mascara within the receptacle 102. Excess mascara may be squeegeed off of the brushes 70 and 72 as they are pulled out of the portals. The mascara receptacle 102 may also be a holding chamber where the brushes 70 and 72 reside, or be stored, until the next usage. The mascara receptacle 102 may have either a single chamber for receiving both brushes 70 and 72 or two separate chambers, each corresponding to a single portal and being configured to receive a single brush 70, 72.

Figure 10:
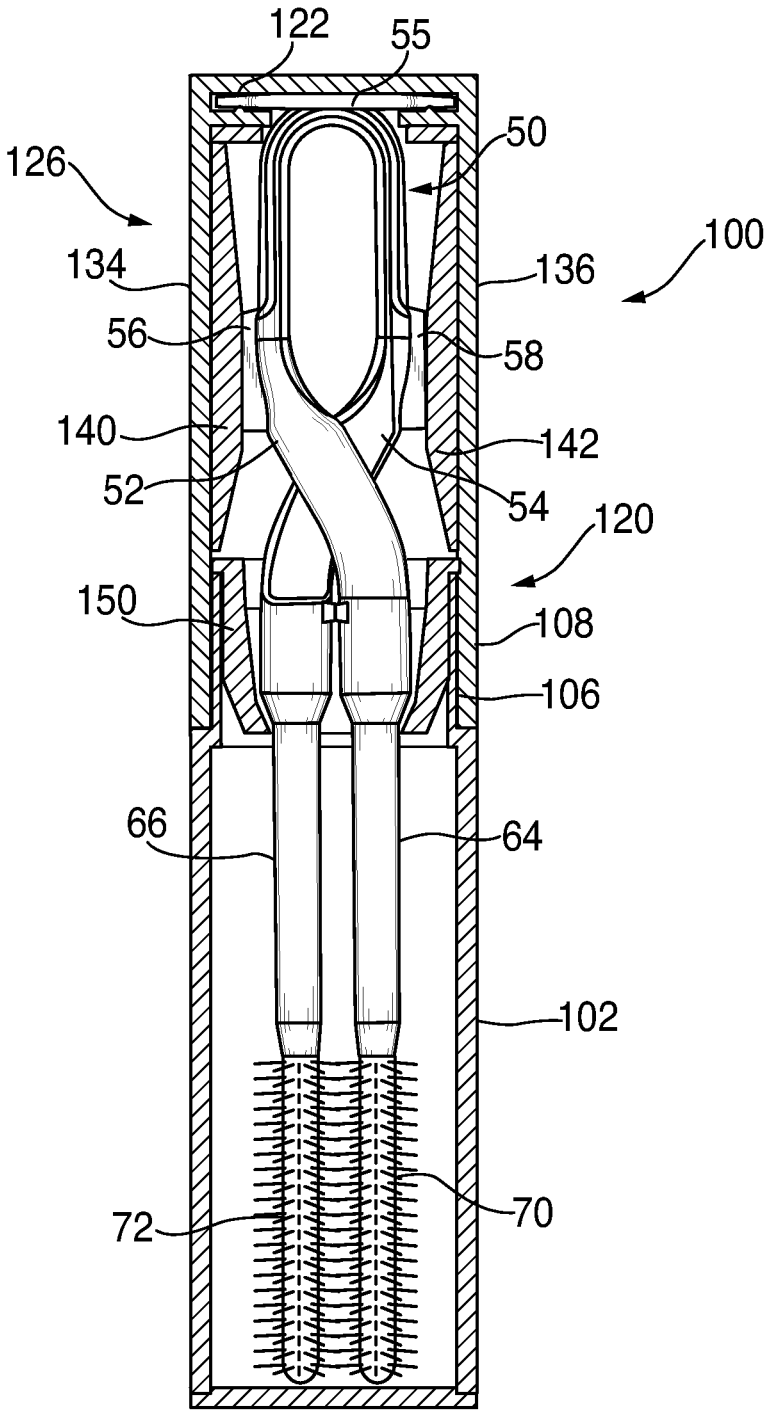
FIG. 10 is a front, elevation view of the applicator of FIG. 9 located within both the reservoir and cap of the container shown in front, elevation, cross-sectional view.

FIG. 10 is a cutaway front view of the mascara container 100 with the applicator 50 therein. The mascara container 100 is configured to be coupled with an applicator container 120. The applicator container 120 houses the upper, or proximal, part of the applicator 50, including the proximal ends of the arms 52 and 54 and any pressure points 56 and 58 thereof. A lower portion 108 of the applicator container 120 is sized to fit snugly over and/or around the wall 106 of the top portion 104 of the mascara container 100 so that the applicator container 120 and the mascara container 100 may fit snugly together and releasably couple to one another.

Figure 11:
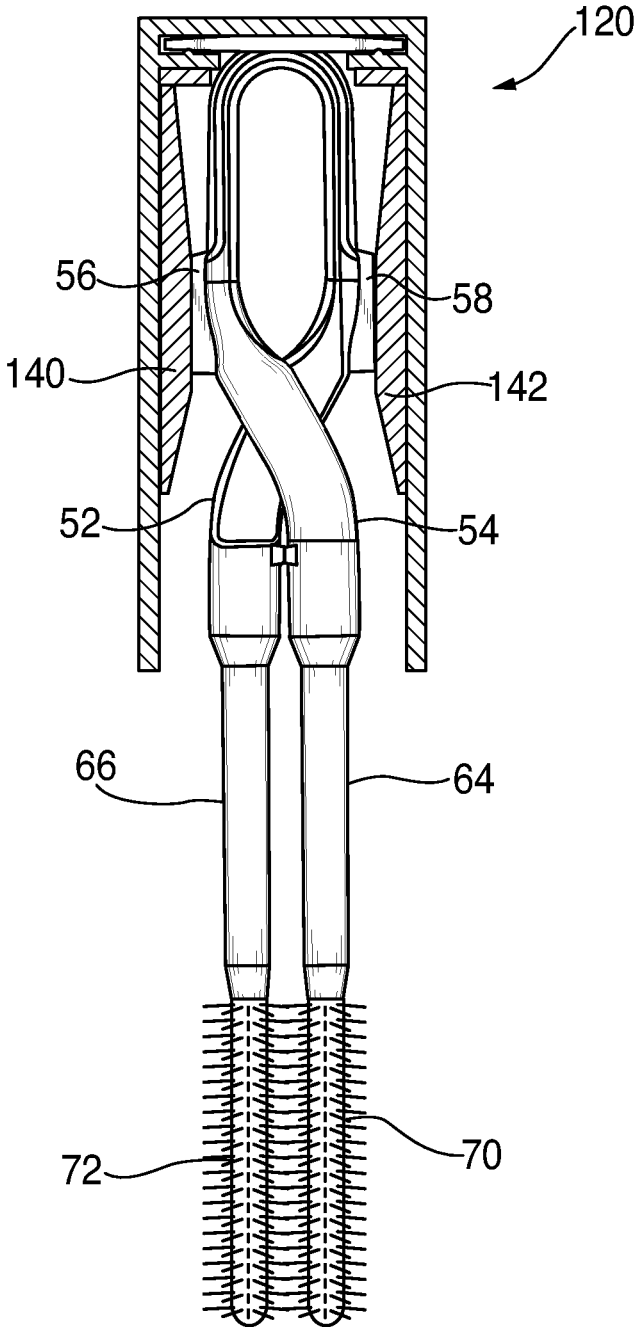
FIG. 11 is a front, elevation view of the applicator of FIG. 9, assembled within the cap shown in a front, elevation, cross-sectional view of the container.

Looking next at FIG. 11, the applicator container 120 is shown separated from the mascara container 102 (FIGS. 9 and 10), with the proximal portion of the applicator 50 in the applicator container. The applicator container 120 may include protrusions 140 and 142 (e.g., convex members, etc.) on an inside surface of the applicator container 120. The protrusions 140 and 142 may be configured to engage corresponding pressure pads 56 and 58 of the applicator 50 (e.g., the protrusions 140 and 142 may be in close proximity, in contact with, etc., the pressure pads 56 and 58). The applicator container 120 may be configured in such a way that, when a transverse force is applied to appropriate opposite locations on the outer surface of the applicator container 120, force may be transmitted the handle portions of the arms 52 and 54 (e.g., via convex members 140 and 142 to pressure tabs 56 and 58, etc.). This action will cause the arms 52 and 54 to move closer together. By means of the reverse tweezers structure discussed above, the wands 64 and 66 may move apart from one another, causing the brushes 70 and 72 to separate, as shown in FIG. 8, so that the brushes 70 and 72 may be positioned above and beneath a user's lashes 98.

Figure 12:
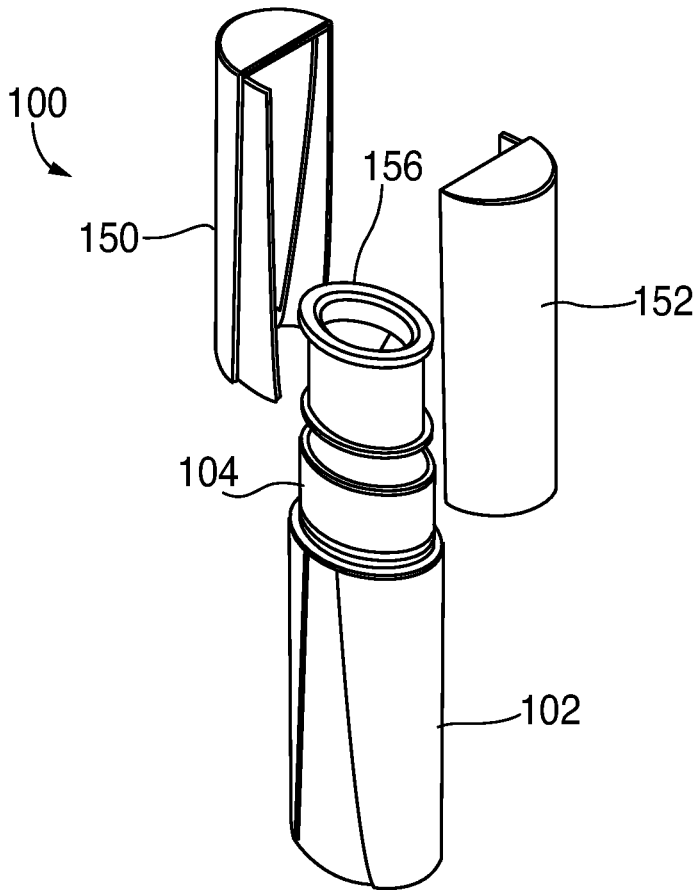
FIG. 12 is an exploded, perspective view of one embodiment of a container for housing an applicator, and represents one embodiment of the container illustrated in FIGS. 9, 10, and 11.

FIG. 12 is an exploded view of an embodiment of the applicator container 120, which includes two members 150 and 152 (e.g., substantially semi-cylindrical members, as shown in FIG. 12, etc.) that may be associated with one another in a manner that enables them to move relative to each other. This movement imparts the applicator container 120 with flexibility, making it possible to squeeze the members 150 and 152 and, thus, the arms 52 and 54 together. This action results in the reverse tweezers action of the applicator 50, causing the wands 64 and 66 and, thus, the brushes 70 and 72 to separate.

Figure 13:
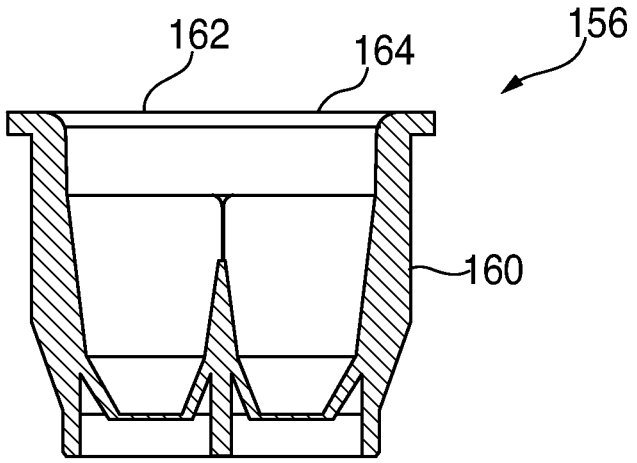
FIG. 13 is a front, elevation, cross-sectional view of the squeegee or wiper mechanism of FIGS. 9, 10, and 11, suitable for receiving the wands of an applicator.

FIG. 12 also shows a tool 156 at the top of the mascara container 100, above the receptacle 102, for removing excess mascara from the brushes 70 and 72 as the brushes are pulled from receptacle 102. This tool 156 may include a pair of squeegees, one at or near the top of a port through which each brush 70, 72 enters and exits the receptacle 102. Alternately, as shown in FIG. 13, the tool 156 may be a squeegee 160 comprising a flexible, resilient material that defines the ports 162 and 164 through which the brushes 70 and 72 enter and exit the receptacle 102. Other mechanisms may alternately be used to remove excess mascara from the brushes.

Figure 14:
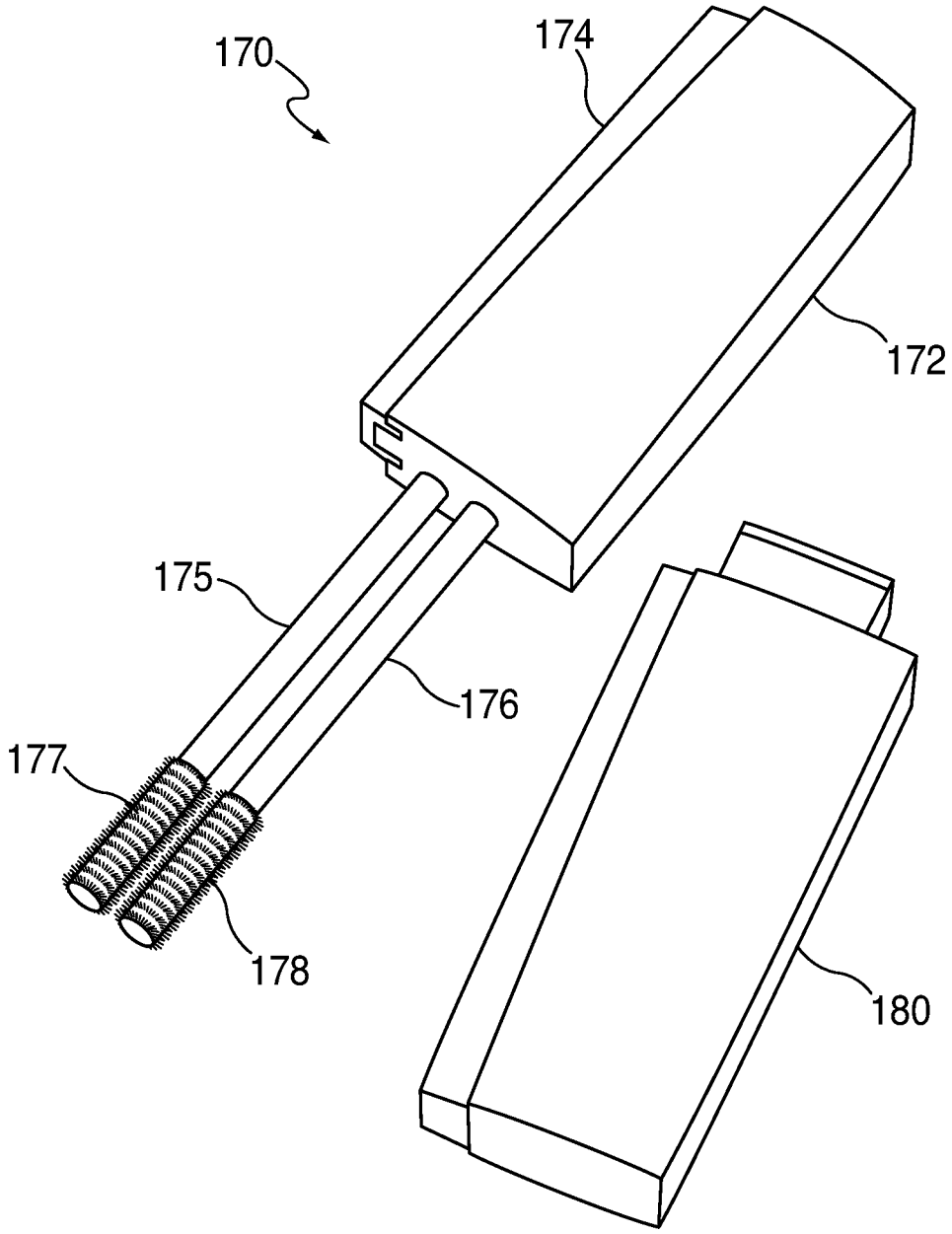
FIG. 14 is a perspective view of an alternative embodiment of an applicator and case (container), with the case open.

FIG. 14 shows another embodiment of a container 170 with an applicator, similar to the applicator shown in FIGS. 1 through 3. In this embodiment, the applicator container 172 has an actuator 174 constructed as a strip along on one side. Applying pressure to the actuator 174 actuates the reverse tweezers mechanism of the handle portion of the applicator within the applicator container 172, causing the wands 175 and 176 and their respective brushes 177 and 178 to move away from each other in a reverse tweezers action, such as that described above. The container 170 also includes a mascara container 180, which is constructed similar to the mascara container shown in and described with reference to FIGS. 9 and 10, with a chamber for mascara, dual ports for accepting the wands 175 and 176 and the brushes 177 and 178 and one or more squeegees (not shown).

Figure 15:
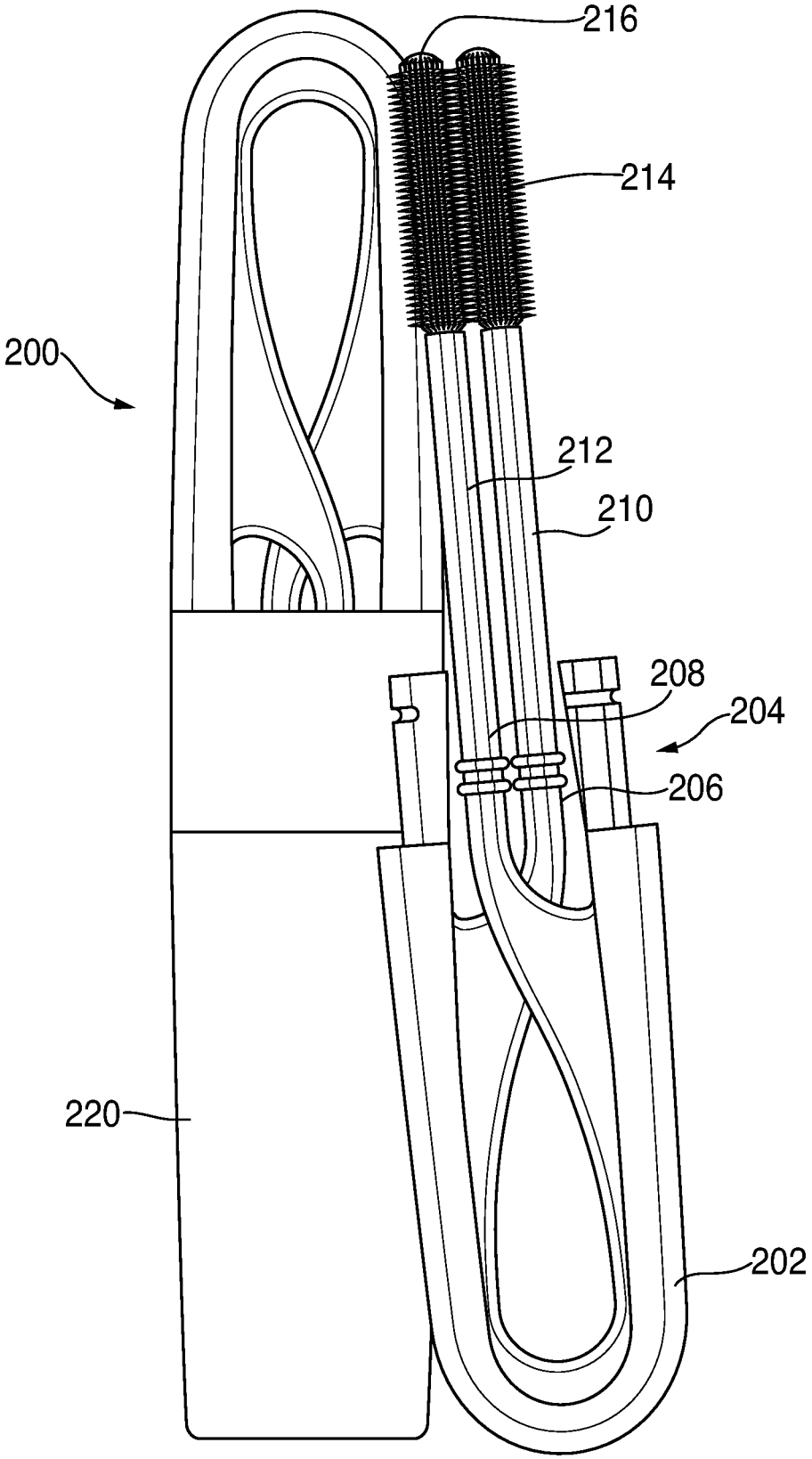
FIG. 15 is a front, elevation view of an alternative embodiment of an applicator, in front of a second applicator in a reservoir in a container.

FIG. 15 shows another embodiment of a container 200 with an applicator, similar to the mascara application systems shown in FIGS. 1 through 3. The applicator container 202 includes open sides, which reveal the handle portions of an applicator 204. The applicator 204 includes arms 206 and 208 that cross over one another, and that correspond to wands 210 and 212, which carry brushes 214 and 216. Applying pressure to appropriate locations on opposite sides of the applicator container 202 actuates the reverse tweezers mechanism, causing the wands 210 and 212 and their corresponding brushes 214 and 216 to move away from each other. The mascara container 220 is constructed similar to the mascara container shown in and described with reference to FIGS. 9 and 10, with a chamber for mascara, dual ports for accepting the wands and brushes and one or more squeegees (not shown).

Advantages

From the foregoing description it can be seen that the arrangement of the dual brushes may decrease the amount of time required to apply mascara, as brushes coat the upper and under sides of the user's top lash at the same time. In some embodiments, the interplay of the dual brushes working together in tandem may simultaneously add volume, lengthen lashes and separate lashes depending on the types of brushes used, a combination of eyelash appearances may result.

A thicker circumference brush holds more mascara within its brushes so it achieves a more voluminous look, a thinner circumference brush with multiple bristles achieves a longer looking lash, and a thinner circumference brush with thinner, more separated bristles achieves lash separation. The brushes may be curved or straight, full or minimal, short or long, bristles or silicone. Some combinations of brushes may achieve various looks that are not easily achieved with a single mascara brush. Examples of dual brush combinations include: (a) a full top brush and a skinny bottom brush, either curved or straight to achieve volume and fullness on the top and to separate and lengthen from the bottom; (b) a full top brush and a full bottom brush, both with short lengths to achieve maximum volume and fullness; (c) top and bottom brushes formed from medium silicone and having a medium length to achieve added length and separation; and (d) top and/or bottom brushes that are sculpted to nest with each other to achieve precision and definition.

The reverse tweezers mechanism facilitates improved user control when applying mascara. Unlike other previous mascara applicators, a steady pressure is automatically applied by the flexible reverse tweezers mechanism, which forces the brushes toward one another in a manner that surrounds and hugs the lashes. Manual pressure is needed only to position the brushes above and beneath the lashes and, in some embodiments, to position the brushes in the mascara container. This action may make the process of applying mascara more spontaneous, manageable, fluid, comfortable, ergonomic and/or efficient.

The applicator may be associated with an applicator container that at least partially encases a proximal, handle portion of the applicator in a manner that enables actuation of the reverse tweezers mechanism. This arrangement may enable the user to apply pressure to one or both sides of the container to move the brushes apart from one another and to release the pressure so that the brushes move back together in a nestled position. In addition, the applicator container may impart the applicator, as well as an assembly of the applicator, the applicator container and the mascara container, with a sleek look.

The mascara container may be configured to hold mascara and the brushes of the applicator. The mascara container may have dual portals through which the two brushes may be brought into contact with the mascara, and two squeegees to remove excess mascara from the brushes and return it to one or more receptacles that contain the mascara. The two portals may also provide a clean and efficient way to hold and store the dual brushes after mascara application has been completed. The dual squeegees may also help to seal the receptacle from exposure to the atmosphere and, thus, prevent drying of the mascara.

It will be understood that the disclosed subject matter may be embodied in other specific forms by one of ordinary skill in the art without departing from the spirit, characteristics or coverage of the disclosed embodiments. The embodiments described herein are to be considered to be illustrative and not restrictive, and the scopes of the claims are not intended to be limited to the details of the described embodiments. Rather, the scope of each claim is defined by its plain language and the full scope of available equivalents thereto, as broadly as the art will permit.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An applicator for mascara, the applicator comprising:
   - a container comprising a handle portion and a chamber portion as a reservoir containing mascara, the container defining a longitudinal direction and a transverse direction, mutually orthogonal;
   - a first arm and a second arm, each supporting at a distal end thereof, respectively, a first mascara brush and a second mascara brush fitted to simultaneously and selectively, as an integrated unit, reside within and remove from the chamber portion;
   - the first and second arms operably connected at proximal ends thereof and shaped to cross one another between respective proximal ends and distal ends of each; and
   - a bias member operating between the first and second arms to maintain together in alignment the brushes in the absence of a force applied in a transverse direction to the arms near the proximal ends thereof.

2. The applicator of claim 1 further comprising a seal positioned between the distal ends and the proximal ends of the first and second arms.

3. The applicator of claim 2, wherein the seal is positioned and shaped to circumscribe each of the first and second arms individually.

4. The applicator of claim 2, wherein the seal is positioned and shaped to seal the handle portion away from the chamber portion.

5. The applicator of claim 2, wherein the seal is positioned and shaped to seal the mascara away from ambient air.

6. The applicator of claim 5, further comprising a wiper effective to remove a portion of the mascara from the brushes by interfering with passage through the wiper by the brushes.

7. The applicator of claim 5, wherein the bias member is a connector integral to the first and second arms proximate the proximal ends thereof.

8. The applicator of claim 7, wherein the bias member is formed continuously and contiguously with the arms to effectively form the proximal ends thereof as a single piece.

9. The applicator of claim 5, wherein the first arm and second arm are movable relative to each other between a first, resting, position with the distal ends thereof positioned parallel to and adjacent one another, and a second, open, position with the distal ends spaced apart in response to pressure in a transverse direction applied proximate the proximal ends thereof.

10. The applicator of claim 2, wherein the first and second arms are formed of a single integral piece of material interconnecting the first and second arms at a vertex about which the arms move in response to a force;

the chamber portion includes a first opening for the first brush and a second opening for the second brush, each provided with a wiping surface effective to redistribute the mascara on the respective first and second brush; and the reservoir is selected from a single cavity and dual cavities containing the mascara.

11. An apparatus as an applicator for supplying mascara, the apparatus comprising:

first and second arms shaped to cross one another and defining longitudinal and transverse directions orthogonal to one another;

the first and second arms having distal ends, respectively, and operably connected proximate first and second proximal ends, respectively, to selectively move between a first, closed, position with the distal ends parallel and adjacent one another, and a second, open position with the distal ends spaced apart in response to a force applied in the transverse direction to the first and second arms near the proximal ends;

first and second brushes secured at the distal ends of the first and second arms, respectively;

a container comprising a chamber operating as a reservoir containing mascara and shaped to selectively receive and release the first and second brushes simultaneously;

a wiper system redistributing a portion of the mascara from the first and second brushes upon withdrawal thereof from the chamber;

the container, further comprising a closure portion operably connected to remove from the chamber portion with the first and second arms; and a seal, sealing the mascara away from ambient air when the first and second brushes are stowed in the chamber.

12. The apparatus of claim 11, further comprising:

a movable member connected to the first and second arms to apply the force.

13. The apparatus of claim 11, further comprising a handle portion containing the proximal ends of the first and second arms and matingly securable to the chamber;

the first and second arms configured as a reverse-action tweezer wherein the distal ends form first and second wands, respectively, maintained substantially parallel to each other with the first and second brushes in contact with each other in the first position; and the first and second arms connected to provide a bias force urging the first and second arms together at the respective distal ends thereof in the first position.

14. The apparatus of claim 13, wherein the first and second arms are flexibly attached to one another proximate the proximal ends thereof as a unitary structure of a single material homogenously formed.

15. The apparatus if claim 11, wherein transverse pressure on the first and second arms separates the distal ends thereof from one another a distance selected to receive therebetween a lash of a user.

16. The apparatus of claim 11, wherein:

the contain comprises a handle portion and the chamber portion, fitted to selectively engage and disengage from one another in a sealing relationship effective to seal the mascara away from ambient air.

17. The apparatus of claim 11, wherein the reservoir is configured to receive simultaneously and release simultaneously, in substantially rigid body relation in a longitudinal direction, both of the first and second brushes.

* * * * *